US007963806B1

(12) United States Patent
Scott Kline et al.

(10) Patent No.: US 7,963,806 B1
(45) Date of Patent: Jun. 21, 2011

(54) ELECTRICAL CONNECTOR AND ASSEMBLY WITH ALIGNED CONTACTING ARMS

(75) Inventors: Richard Scott Kline, Mechanicsburg, PA (US); Howard Wallace Andrews, Hummelstown, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/727,257

(22) Filed: Mar. 19, 2010

(51) Int. Cl.
*H01R 24/00* (2011.01)
*H01R 33/00* (2006.01)

(52) U.S. Cl. ..... 439/660; 439/607.08

(58) Field of Classification Search ..... 439/660, 439/857, 607.08, 607.09, 607.1, 607.11, 439/607.05, 607.07
See application file for complete search history.

(56) References Cited

U.S. PATENT DOCUMENTS

| | | | | |
|---|---|---|---|---|
| 7,775,802 | B2 * | 8/2010 | Defibaugh et al. | 439/65 |
| 2005/0009414 | A1 * | 1/2005 | Schorr et al. | 439/857 |
| 2005/0164555 | A1 * | 7/2005 | Winings et al. | 439/608 |
| 2005/0272318 | A1 * | 12/2005 | Schorr et al. | 439/857 |
| 2008/0318455 | A1 * | 12/2008 | Beaman et al. | 439/108 |
| 2009/0011645 | A1 * | 1/2009 | Laurx et al. | 439/608 |
| 2009/0011664 | A1 | 1/2009 | Larux et al. | |
| 2009/0264023 | A1 | 10/2009 | Yi et al. | |

* cited by examiner

*Primary Examiner* — Hae Moon Hyeon
(74) *Attorney, Agent, or Firm* — Ming Chieh Chang; Wei Te Chung; Andrew C. Cheng

(57) ABSTRACT

An electrical connector assembly includes a header connector and a mateable receptacle connector. The header connector includes a number of header contacts each including a contacting section. The receptacle connector includes a mating face and a number of receptacle contacts extending beyond the mating face. The receptacle contacts include a first contact part having a connecting portion, a first arm extending from a front end of the connecting portion along a first direction and a second arm extending from a rear end of the connecting portion along a second direction opposite to the first direction. The first and the second arms are aligned with each other and are configured to engage a common side of the contacting section in the header connector.

19 Claims, 9 Drawing Sheets

ELECTRICAL CONNECTOR AND ASSEMBLY WITH ALIGNED CONTACTING ARMS

BACKGROUND OF THE INVENTION

1. Field of the Invention

The present invention relates to an electrical connector and an assembly with aligned contacting arms, and more particularly to an electrical connector and an assembly with simplified contacting arms extending from a common connecting portion to realize cost-effective manufacturing process.

2. Description of Related Art

U.S. Patent Application Publication No. 2009/0264023 published on Oct. 22, 2009 discloses an electrical connector assembly including a header connector and a mateable receptacle connector. The header connector includes a plurality of header contacts each having a flat contacting portion near a distal end thereof. The receptacle connector includes a plurality of wafers each comprising a plurality of receptacle contacts. Each receptacle contact includes a pair of contact springs in side-by-side manner for engaging with a common header contact for signal transmission. Obviously, such side-by-side contact springs will widen each receptacle contact at its contacting position as a result that the profile of the receptacle connector cannot be reduced. Besides, such contact configuration will limit contact density arrangement especially in high speed signal transmission areas. U.S. Patent Application Publication No. 2009/0011664 published on Jan. 8, 2009 discloses a similar design in this regard.

Hence, an improved electrical connector and an assembly with simplified contacting arms extending from a common connecting portion are needed to solve the above problem.

BRIEF SUMMARY OF THE INVENTION

The present invention provides an electrical connector assembly including a header connector and a receptacle connector mateable with the header connector. The header connector includes an insulative body and a plurality of header contacts retained in the insulative body. The header contacts each includes a contacting section projecting from the insulative body. The receptacle connector includes a mating face and a plurality of receptacle contacts extending beyond the mating face. At least one of the receptacle contacts includes a first contact part which includes a connecting portion, a first arm extending from a front end of the connecting portion along a first direction, and a second arm extending from a rear end of the connecting portion along a second direction opposite to the first direction. The first and the second arms are aligned with each other and are configured to engage a common side of the contacting section in the header connector for decreasing the contacting width thereof. Besides, the first and the second are provided with multi contact points in order to enhance stable engagement with the header contacts. More over, since both the first and the second arms extend from the common connecting portion, the structure of the first contact part is simplified for easy manufacture.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
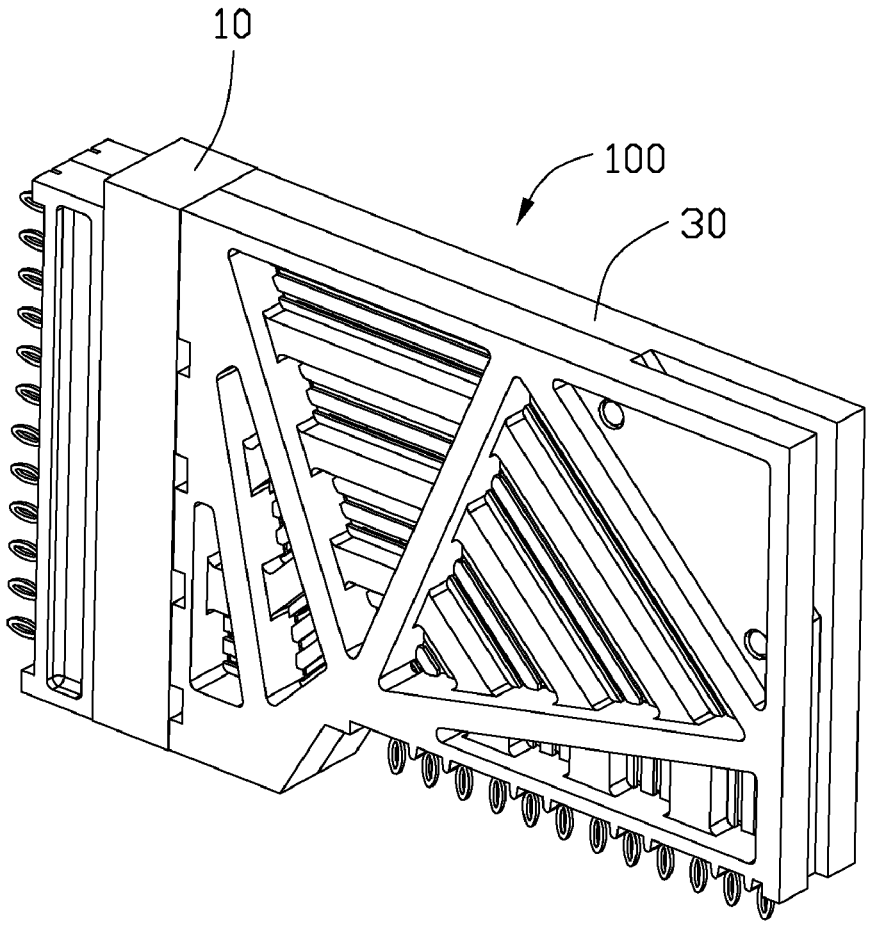
FIG. 1 is a perspective view of an electrical connector assembly with a header connector mateable with a receptacle connector in accordance with an embodiment of the present invention.

Reference will now be made to the drawing figures to describe the preferred embodiment of the present invention in detail. FIGS. 1 to 4 illustrate an electrical connector assembly 100 including a header connector 10 and a mateable receptacle connector 30.

Figure 2:
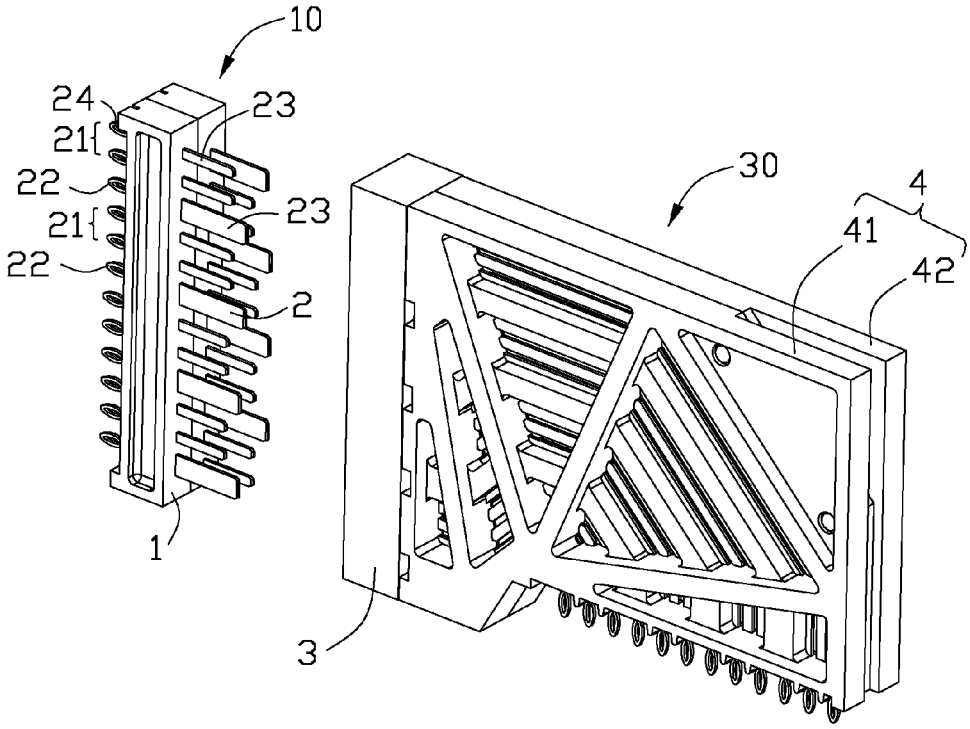
FIG. 2 is a perspective view of the electrical connector assembly with the header connector separated from the receptacle connector.

As shown in FIG. 2, the header connector 10 includes an insulative body 1 and a plurality of flat header contacts 2 retained in the insulative body 1. The header contacts 2 include differential signal contact pairs 21 and grounding contacts 22 disposed between the adjacent differential signal contact pairs 21. The header contacts 2 each includes a contacting section 23 projecting from the insulative body 1 and a complaint terminal 24 for being mounted to a backplane PCB (not shown). The contacting section 23 of each grounding contact 22 is much wider than that of each differential signal contact 21 for shielding effectiveness. The header contacts 2 are arranged in columns and rows.

Figure 3:
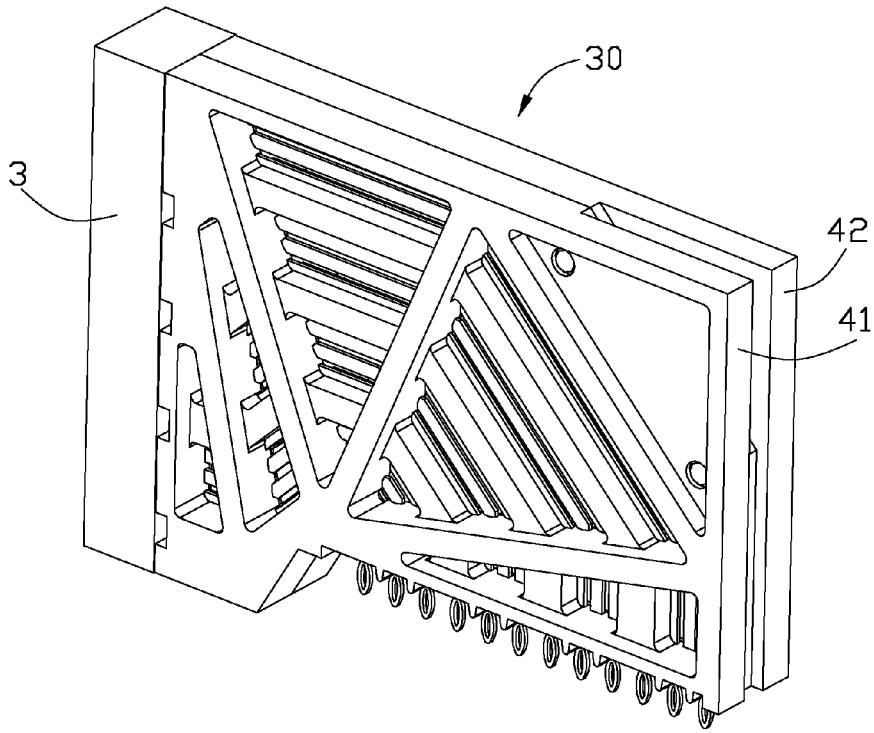
FIG. 3 is a perspective view of the receptacle connector as shown in FIG. 2.
Figure 4:
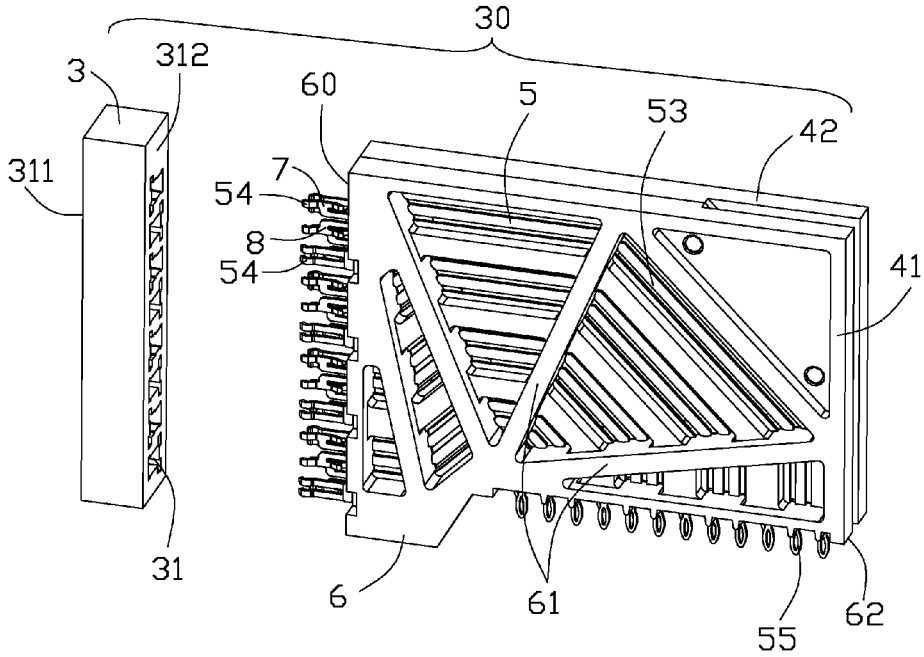
FIG. 4 is a part exploded view of the receptacle connector with a front cover disassembled to a pair of wafers.
Figure 5:
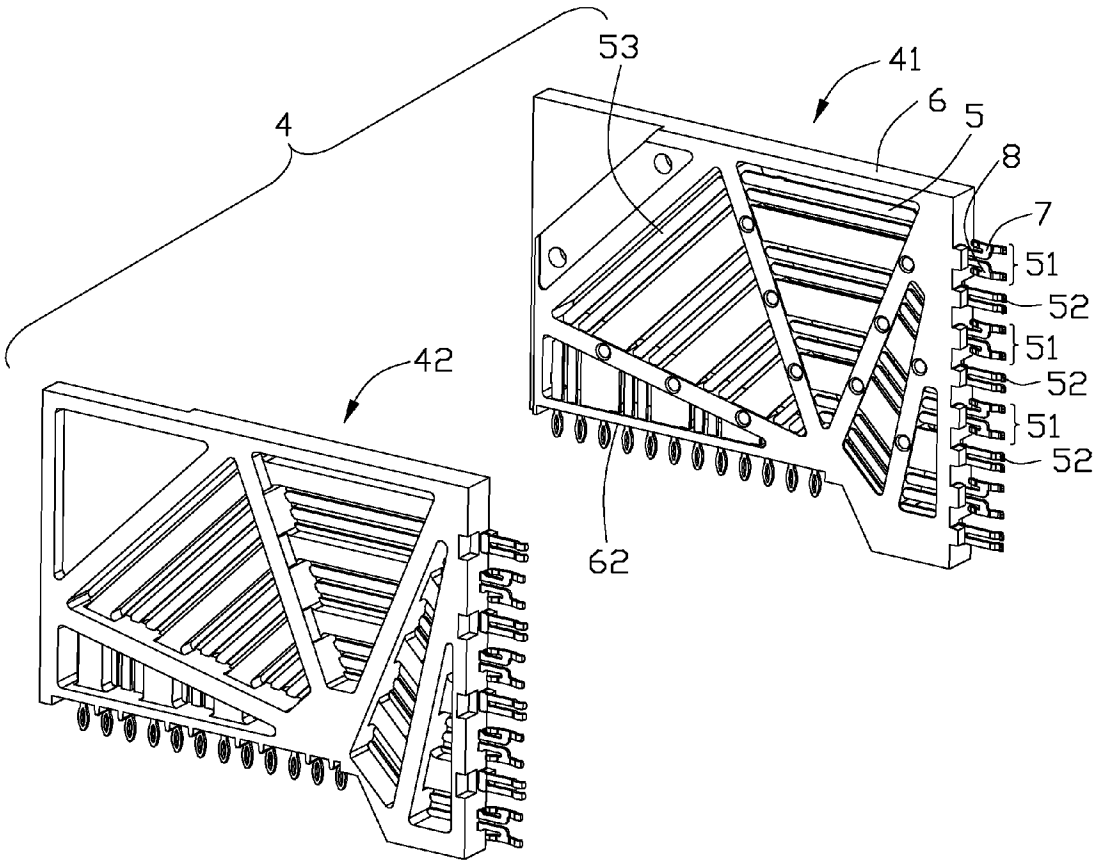
FIG. 5 is a perspective view of the pair of wafers separated from each other.
Figure 6:
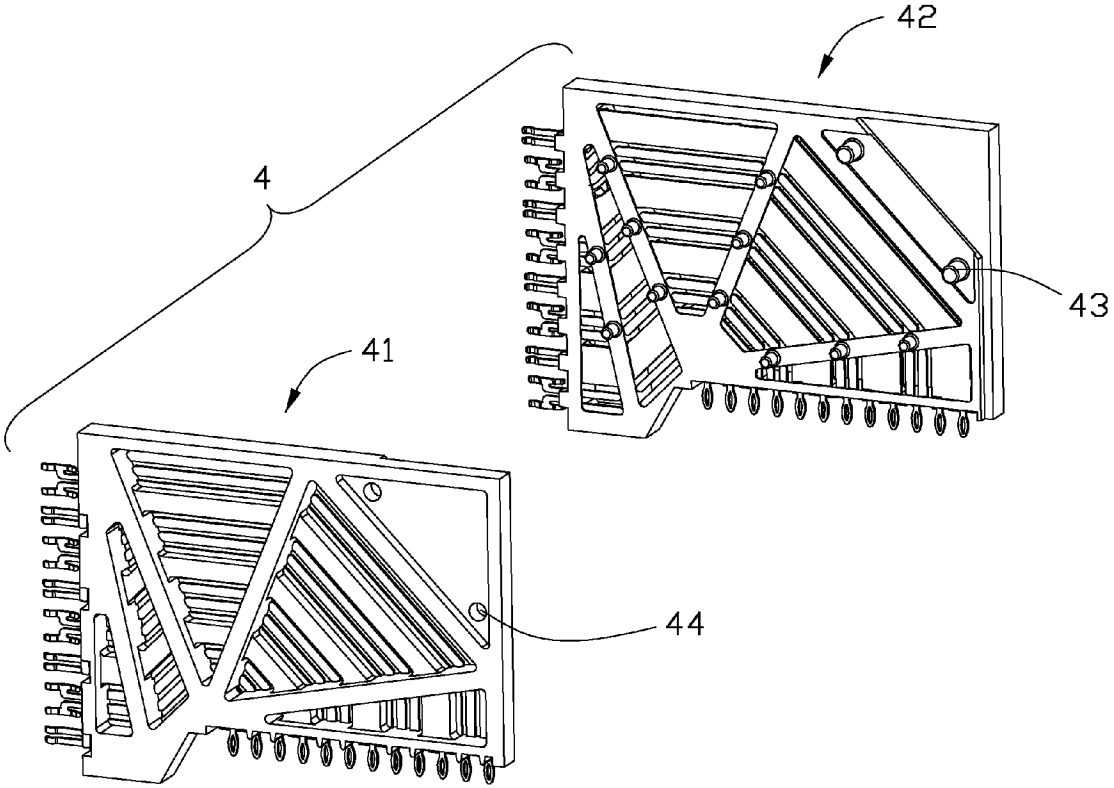
FIG. 6 is another perspective view similar to FIG. 5, while taken from another aspect.

As shown in FIGS. 3&4, the receptacle connector 30 includes a front cover 3 and a pair of wafers 4 inserted to the front cover 3. The front cover 3 defines a plurality of passageways 31 through front and rear surfaces 311, 312 thereof. The pair of wafers 4 include a first wafer 41 and a second wafer 42 coupled with each other. As shown in FIGS. 5&6, the first and the second wafers 41, 42 include lockable posts 43 and depressions 44 so that the first and the second wafers 41, 42 can be combined together prior to be assembled to the front cover 3. Since the first and the second wafers 41, 42 are of the similar configuration, and only the first wafer 41 will be detailedly described hereinafter for simplicity.

The first wafer 41 includes a plurality of receptacle contacts 5 and a first insulator 6 over-molding the receptacle contacts 5. The first insulator 6 is rectangular shaped and includes a front mating face 60 and a plurality of support spokes 61. The receptacle contacts 5 include paired differential signal contacts 51 and grounding contacts 52 disposed between the adjacent paired differential signal contacts 51. Each receptacle contact 5 includes a middle portion 53 partly retained in the support spokes 61, a contact part 54 extending forwardly beyond the mating face 60 and a complaint terminal 55 extending downwardly beyond a mounting edge 62 of the first insulator 6. The first middle portions 53 are partly exposed to the air for impedance matching. The contact parts 54 include a first contact part 7 disposed at one of the paired differential signal contacts 51 and a second contact part 8 disposed at the other of the paired differential signal contacts 51.

Figure 7:
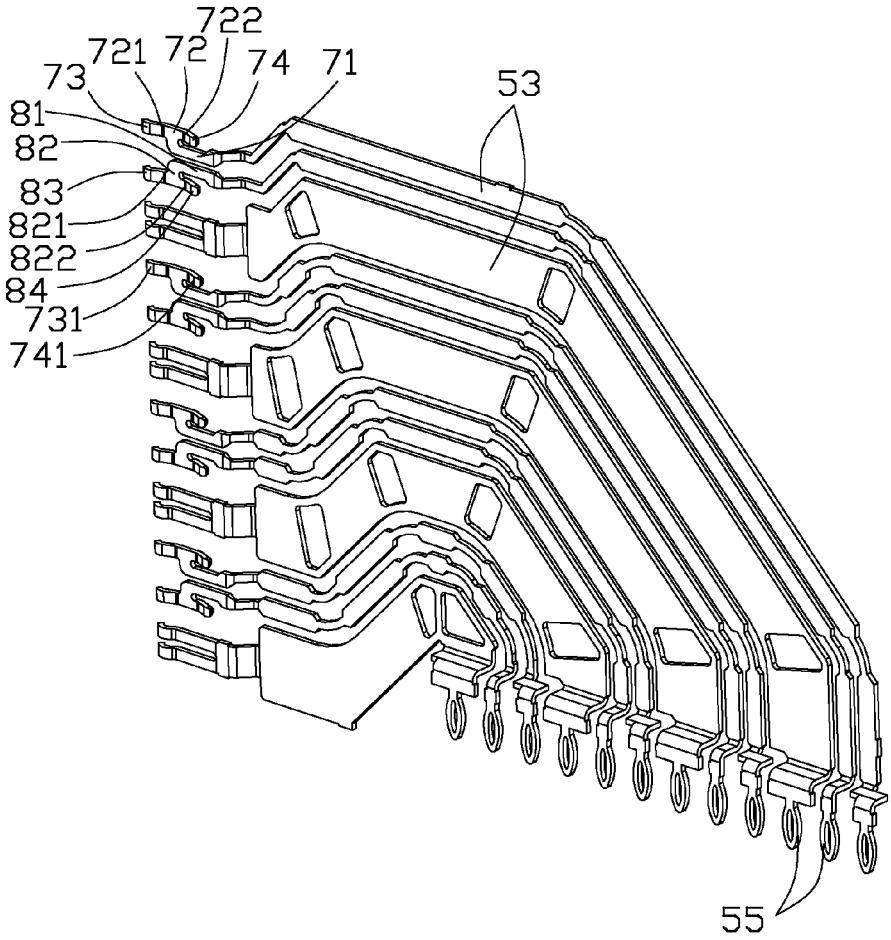
FIG. 7 is a perspective view of a plurality of receptacle contacts in a single wafer.

As shown in FIG. 7, the first contact part 7 includes a first extension 71 protruding from the mating face 60, a first connecting portion 72, a first arm 73 extending forwardly from a front end 721 of the first connecting portion 72 along a first direction and a second arm 74 extending backwardly from a rear end 722 of the connecting portion 72 along a second direction opposite to the first direction. The first extension 71 connects the first connecting portion 72 to jointly form a L-shaped configuration. The first extension 71 is parallel to and spaced apart from the first and the second arms 73, 74. The first and the second arms 73, 74 are substantially of the same length while the first extension 71 is longer than either the first arm 73 or the second arm 74 in order to enhance elasticity thereof. The bifurcated first and the second arms 73, 74 are in cantilever manner for robust deformation. The first and the second arms 73, 74 include first and second protuberances 731, 741 near distal ends thereof, respectively. The first and the second protuberances 731, 741 are adapted to form multi contact points for enhancing stable engagement with the header contacts 2. The first and the second protuberances 731, 741 are aligned with each other for decreasing the contacting width thereof so as to mate with the narrow contacting section 23 of the corresponding differential signal contact 21 of the header connector 1. Besides, the first and the second protuberances 731, 741 are configured to sequentially engage a common side 231 of the contacting section 23 in the header connector 1 as shown in FIG. 9.

Figure 8:
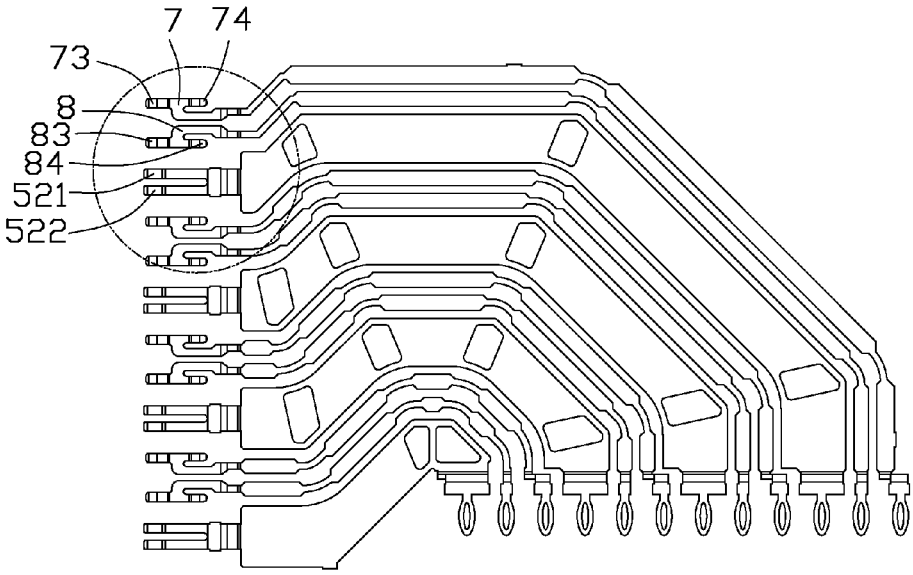
FIG. 8 is a side view of the plurality of receptacle contacts shown in FIG. 7.
Figure 9:
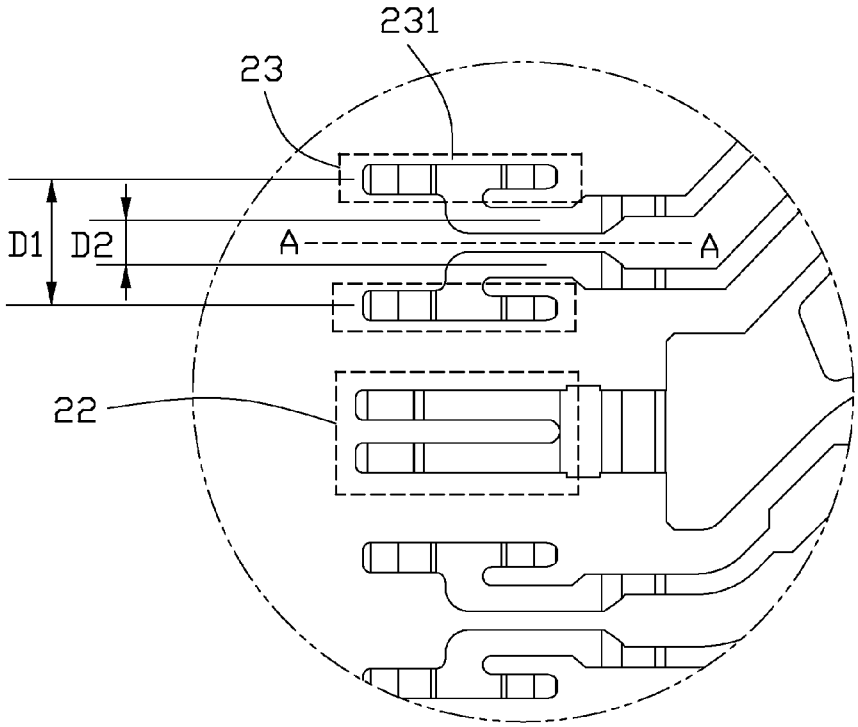
FIG. 9 is an enlarged view of a circle portion shown in FIG. 8.

As shown in FIGS. 7 to 9, the first and the second contact parts 7, 8 are symmetrical along an imaginary plane A-A which is perpendicular to the mating face 60. The second contact part 8 includes a second extension 81 protruding from the mating face 60, a second connecting portion 82, a third arm 83 extending forwardly from a front end 821 of the second connecting portion 82 along the first direction and a fourth arm 84 extending backwardly from a rear end 822 of the second connecting portion 82 along the second direction opposite to the first direction. The second extension 81 connects the second connecting portion 82 to jointly form a L-shaped configuration. The third and the fourth arms 83, 84 are cantilevered for robust flexibility. The third and the fourth arms 83, 84 are aligned with each other and are configured to engage a common side of the contacting section 23 in the header connector 1 as well. A distance D1 either between the first arm 73 and the third arm 83 or between the second arm 74 and the fourth arm 84 is larger than another distance D2 between the first and the second connecting portions 71, 81. As a result, contacting points of the first and the second contact parts 7, 8 are spaced a suitable distance from each other in order to avoid error mating of the adjacent first and the second contact parts 7, 8 when the header contacts 2 are inserted into the receptacle connector 30.

Further referring to FIGS. 4-9, in both the first wafer 41 and the second wafer 42, the differential signal contacts 51 and the grounding contacts 52 comprising the corresponding middle portions 53 connecting the corresponding contact parts 54, are alternately arranged with each other in the vertical direction. In each paired differential signal contacts 51, a pitch (not labeled) defined between the middle portions 53 is smaller than a pitch D1 defined between the first arm 73 of the first contact part 7 and the third arm 83 of the second contact 8 part of the corresponding contact part 54.

The contact part 54 of each grounding contact 52 includes a pair of parallel contacting portions 521, 522 extending beyond the mating face 60. The pair of contacting portions 521, 522 are arranged one above the other and are configured to engage a common side of the contacting section 23 of the corresponding grounding contact 22 in the header connector 1. Since the contacting section 23 of each grounding contact 22 is much wider than that of each differential signal contact 21, a reasonable contacting width can be provided to engage with the pair of contacting portions 521, 522. Referring to FIGS. 5 and 8, in each paired differential signal contacts 51 of the first wafer 41 and the second wafer 42, the first and the second connecting portions 72, 82 are bent along opposite vertical directions so that an enlarged distance is formed between the first and the third arms 73, 83, or between the second and fourth arms 74, 84. As a result, the adjacent first and the third arms 73, 83, or the adjacent second and fourth arms 74, 84 are less likely to contact each other to avoid signal confusion. As shown in FIGS. 5 and 6, from another viewpoint, when the first wafer 41 and the second wafer 42 are stacked with each other along a horizontal direction, the contacting portions 521, 522 of each grounding contact 52 of the first wafer 41 reside in the enlarged distance formed between the corresponding paired differential signal contacts 51 of the second wafer 42, as viewed along the horizontal direction. Similarly, the contacting portions 521, 522 of each grounding contact 52 of the second wafer 42 reside in the enlarged distance formed between the corresponding paired differential signal contacts 51 of the first wafer 41, as viewed along the horizontal direction.

It is also noted that in each grounding contact 52 of both first wafer 41 and the second wafer 42, the corresponding middle portion 53 is dimensioned larger than the corresponding contact part 54 in the vertical direction.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a header connector comprising an insulative body and a plurality of header contacts retained in the insulative body, the header contacts each comprising a contacting section projecting from the insulative body; and a receptacle connector mateable with the header connector and comprising a mating face and a plurality of receptacle contacts extending beyond the mating face, at least one of the receptacle contacts comprising a first contact part which comprises a connecting portion, a first arm extending from a front end of the connecting portion along a first direction, and a second arm extending from a rear end of the connecting portion along a second direction opposite to the first direction, the first and the second arms being aligned with each other and being configured to engage a common side of the contacting section of a corresponding header contact.

2. The electrical connector assembly as claimed in claim 1, wherein the first and the second arms are cantilevered and comprise first and second protuberances adjacent to distal ends thereof, respectively, to sequentially engage the common side of the contacting section.

3. The electrical connector assembly as claimed in claim 1, wherein the first and the second arms are substantially of the same length.

4. The electrical connector assembly as claimed in claim 1, wherein the first contact part comprises an extension protruding from the mating face, the extension connecting the connecting portion to jointly form a L-shaped configuration.

5. The electrical connector assembly as claimed in claim 4, wherein the extension is parallel to and spaced apart from the first and the second arms.

6. The electrical connector assembly as claimed in claim 4, wherein the extension is longer than either the first arm or the second arm.

7. The electrical connector assembly as claimed in claim 1, wherein the receptacle contacts comprise a second contact part paired with the first contact part in order to form a differential signal pair.

8. The electrical connector assembly as claimed in claim 7, wherein the first and the second contact parts are symmetrical along an imaginary plane which is perpendicular to the mating face.

9. The electrical connector assembly as claimed in claim 7, wherein the second contact part comprises another connecting portion, a third arm extending from a front end of the another connecting portion along the first direction and a fourth arm extending from a rear end of the another connecting portion along the second direction opposite to the first direction, a distance between the first arm and the third arm is larger than that between the connecting portion and the another connecting portion.

10. The electrical connector assembly as claimed in claim 7, wherein the receptacle contacts comprise a grounding contact adjacent to the differential signal pair, the grounding contact comprising a pair of parallel contacting portions extending beyond the mating face, the pair of contacting portions being arranged one above the other and being configured to engage a common side of a corresponding contacting section of the header contact.

11. An electrical connector comprising:

an insulator defining a mating face; and a plurality of contacts embedded in the insulator, at least one of the contacts comprising a first contact part extending beyond the mating face, the first contact part comprising a connecting portion, a first arm extending from a front end of the connecting portion along a first direction, and a second arm extending from a rear end of the connecting portion along a second direction opposite to the first direction, the first and the second arms being aligned with each other and being configured to engage a common side of a mating contact; wherein the contacts comprise a second contact part paired with the first contact part in order to form a differential signal pair, the first and the second contact parts being symmetrical along an imaginary plane which is perpendicular to the mating face.

12. The electrical connector as claimed in claim 11, wherein the first and the second arms are cantilevered and comprise first and second protuberances adjacent to distal ends thereof, respectively, to sequentially engage the common side of the mating contact.

13. The electrical connector as claimed in claim 11, wherein the first contact part comprises an extension connecting the connecting portion, the extension being parallel to and spaced apart from the first and the second arms.

14. An electrical connector comprising:

first and second terminal modules staked with each other in a horizontal direction;

a plurality of first differential pair signal contacts and first grounding contacts being alternately arranged with each other in the first terminal module wherein first contacting sections of the first differential pair signal contacts and the first grounding contacts are alternately arranged with each other in a vertical direction perpendicular to said horizontal direction; and a plurality of second differential pair signal contacts and second grounding contacts being alternately arranged with each other in the second terminal module wherein second contacting sections of the second differential pair signal contacts and the second grounding contacts are alternately arranged with each other in said vertical direction; wherein each first differential pair of the corresponding first differential signal contacts are essentially aligned with the corresponding second grounding contact in the horizontal direction under condition that two first contacting sections of each first differential pair extend away from each other to enlarge a space therebetween in the vertical direction so as to sandwich the second contacting section of the corresponding second grounding contact in the vertical direction in a side view; wherein each second differential pair of the corresponding second differential signal contacts are essentially aligned with the corresponding first grounding contact in the horizontal direction under condition that two second contacting sections of each second differential pair extend away from each other to enlarge a space therebetween in the vertical direction so as to sandwich the first contacting section of the corresponding first grounding contact in the vertical direction in the side view.

15. The electrical connector as claimed in claim 14, wherein the second contacting section of the second grounding contact defines a bifurcated shape with two spring arms spaced from each other in said vertical direction; the first contacting section of the first grounding contact defines another bifurcated shape with two spring arms spaced from each other in the vertical direction.

16. The electrical connector as claimed in claim 14 wherein said first contacting section of each of the corresponding first differential pair of said first differential pair signal contacts defines two opposite resilient arms inline in a mating direction perpendicular to both said horizontal direction and said vertical direction; said second contacting section of each of the corresponding second differential pair of said second differential pair signal contacts defines two opposite resilient arms inline in the mating direction.

17. The electrical connector as claimed in claim 16, wherein said two resilient arms of each first contacting section and each second contacting section are joined with each other in an intermediate position between two respective contacting ends of said two resilient arms in said mating direction.

18. The electrical connector as claimed in claim 14 wherein the first differential pair signal contacts and the first grounding contacts comprise first middle sections connecting the corresponding first contacting sections and being alternately arranged with each other in said vertical direction, in each first differential pair of the corresponding first differential pair signal contacts, a pitch defined by the first middle sections being smaller than a pitch defined by the corresponding first contacting sections; and the second differential pair signal contacts and those of the second grounding contacts comprises second middle sections connecting the corresponding second contacting sections and being alternately arranged with each other in said vertical direction, in each second differential pair of the corresponding second differential pair signal contacts, a pitch defined by the second middle sections being smaller than a pitch defined by the corresponding second contacting sections.

19. The electrical connector as claimed in claim 18, wherein in each first grounding contact, the corresponding first middle section is dimensioned larger than the corresponding first contacting section in said vertical direction; in each second grounding contact, the corresponding second middle section is dimensioned larger than the corresponding second contacting section in said vertical direction.

* * * * *